US012781513B2

(12) United States Patent
Gutkowski et al.

(10) Patent No.: US 12,781,513 B2
(45) Date of Patent: Nov. 3, 2026

(54) JOINT OF FLOOR PANELS

(71) Applicant: "BARLINEK" SPÓLKA AKCYJNA, Kielce (PL)

(72) Inventors: Pawel Gutkowski, Barlinek (PL); Marek Konstańczak, Barlinek (PL); Grzegorz Łasak, Gorzów Wielkopolski (PL)

(73) Assignee: "BARLINEK" SPÓŁKA AKCYJNA, Kielce (PL)

( * ) Notice: Subject to any disclaimer, the term of this patent is extended or adjusted under 35 U.S.C. 154(b) by 147 days.

(21) Appl. No.: 18/996,092

(22) PCT Filed: Apr. 10, 2024

(86) PCT No.: PCT/IB2024/053507
§ 371 (c)(1),
(2) Date: Jan. 17, 2025

(87) PCT Pub. No.: WO2024/218613
PCT Pub. Date: Oct. 24, 2024

(65) Prior Publication Data

US 2026/0028829 A1 Jan. 29, 2026

(30) Foreign Application Priority Data

Apr. 20, 2023 (PL) ..... 444501

(51) Int. Cl.
*E04F 15/02* (2006.01)

(52) U.S. Cl.
CPC .. *E04F 15/02011* (2013.01); *E04F 15/02033* (2013.01)

(58) Field of Classification Search
CPC ..... E04F 15/02011; E04F 15/02033; E04F 15/02038; E04F 15/04; E04F 2201/0146; E04F 2201/0153; E04F 2201/0176; E04F 2201/023; E04F 2203/08; E04F 15/02
See application file for complete search history.

(56) References Cited

U.S. PATENT DOCUMENTS

| | | | | |
|---|---|---|---|---|
| 2020/0308846 | A1* | 10/2020 | Josefsson | E04F 13/14 |
| 2021/0198901 | A1* | 7/2021 | Josefsson | E04F 15/105 |
| 2023/0015897 | A1 | 1/2023 | Markovski | |
| 2023/0131686 | A1* | 4/2023 | Weller | A47K 3/405 52/578 |

FOREIGN PATENT DOCUMENTS

WO 8504922 A1 11/1985

* cited by examiner

*Primary Examiner* — Patrick J Maestri
(74) *Attorney, Agent, or Firm* — Renner, Kenner, Greive, Bobak, Taylor & Weber, Co. LPA

(57) ABSTRACT

A floor panel (1) has interlocking means (10, 11) formed on the side of its short edges (5, 5') being joined together. These interlocking means (10, 11) comprise joining parts made as a male joining part (9) and a female joining part (12) and have a vertically active concave locking part (13) and a convex locking part (14), as well as slanted guiding surfaces (15, 16). Furthermore, there is a bendable part (7) formed in the lower surface (2*a*) of the floor panel (1), comprising a plurality of adjacent recesses (8, 8') formed in the lower surface (2*a*), next to the male joining part (9), which are inclined relative to the short edge (5') of the side surface (6'), allowing the angular deflection of the male joining part (9) to be increased, relative to the horizontal plane, during its interlocking with the female joining part (12) at the short edges (5, 5').

10 Claims, 5 Drawing Sheets

JOINT OF FLOOR PANELS

The subject of the invention is a joint of floor panels, intended for interlocking adjacent panels. The invention is applicable to floor panels made of solid wood, engineered wood floor panels, laminated wood-based panels and floor panels manufactured from conglomerates of different materials.

TECHNICAL FIELD

The interlocking of floor panel joints is performed using complementary interlocking means, formed near the joined edges, and is intended to lock the joined floor panels in a direction perpendicular to the upper surface of the panel and in a direction parallel to this surface. Such complementary interlocking means are usually made as a male joining part and a female joining part, and have latching elements to enable a stable join, so that there is no accidental disjoining after interlocking. However, such latching elements are difficult to join, so that it often becomes necessary to press together the parts to be joined using high pressing forces and sometimes using impact force in the form of blows with a rubber hammer.

BACKGROUND ART

The difficulty of joining the interlocking means increases considerably when joining plastic panels, in particular vinyl or SPC panels, due to the increased frictional resistance of such materials. An example of joining plastic panels is disclosed in US20200362567A1. In this known joint, once the long edges of the joined panels have been joined by means of a mechanical angular locking system, the lock on the short side is achieved by gradually pressing down the downward projecting interlocking element, while bending it and moving the pressing force in a direction from where the long edges are joined to the opposite long edge, causing the transverse lock to engage completely.

In other known solutions, such as in EP2339092B1, an additional deflecting element in the form of a board is used to facilitate smooth joining of the interlocking means. Such a deflecting element is underlaid during assembly, close to the female joining part, so that the latter is raised above the floor during assembly. In such a position, when applying vertical pressure, the male part fits more smoothly into the female part.

From EP3238899B1 a panel locking system is known in which the lower part of the female fixing part has a reduced thickness, so that the lip of the female fixing part is raised above the floor. Such a design increases the flexibility of the lower lip, thereby reducing the amount of angular pressure needed for the male joining part to fit in smoothly.

In WO2020083613A1, the lower female joining part has a lower undercut in its lower part essentially underneath the entire length of the protruding lip, which increases its susceptibility to deformation and therefore also aims to interlock the parts to be joined while a lower pressing force is exerted.

In WO2015144726A1 a hinged form of the lower lip formed by its local U- or V-shaped recess in the lower surface of the floor panel across its entire width is disclosed. Thus, the recess site forms a local weakening and simultaneously a hinge of a certain sort. The recess can be made by cutting a slit in the undersurface of the other panel.

In WO2016113677A1, the lower part of the male fixing part has an undercut or a notch in the lower part of the panel that is parallel to the floor, allowing their mounting even in case of a certain difference in the thickness of the panels to be joined.

In known solutions from the state of the art, causing the interlocking means to bend using additional deflection elements underlaid during assembly near the female joining part is a major inconvenience that increases assembly time. In contrast, reducing the thickness of the female fixing part by use of a local undercut results in a local reduction in the stiffness of the laid floor in the direction perpendicular to their top surface. In areas where such undercuts are made, the surface of the panel may collapse, for example under the pressure exerted by a shoe, especially one with a narrow heel. Panels of small thickness are particularly susceptible to this detrimental phenomenon.

SUMMARY OF INVENTION

The aim of the invention is to develop a joint of floor panels, wherein the design of the interlocking means ensures easy joining and vertical and horizontal fixing, as well as protection against accidental disjoining.

In the joint of floor panels according to the invention, the floor panels to be joined are in the form of rectangular plates comprising:

- an upper surface and a lower surface parallel to it, designed to be laid on the subfloor,
- two long edges of side surfaces,
- two short edges of side surfaces,
- complementary interlocking means formed on the side of the edges being joined to each other.

The complementary interlocking means formed on the side of the short edges being joined to each other comprise joining parts made as a male joining part and a female joining part and have a vertically active concave locking part and a convex locking part, and slanted guiding surfaces, also with a bendable part formed in the lower surface of the floor panel, across its entire width.

The solution is characterised in that the bendable part of the floor panel comprises a plurality of adjacent recesses formed in the lower surface, next to the male joining part, which are inclined relative to the short edge of the side surface, allowing the angular deflection of the male joining part to be increased, relative to the horizontal plane, during its interlocking with the female joining part at the short edges.

Preferably, the bendable part of the floor panel comprises 3 to 20 adjacent recesses.

Preferably, the bendable part of the floor panel comprises 4 to 10 adjacent recesses.

Preferably, the first recess on the side of the short edge is inclined by an angle greater than the inclination angle of the further recesses with respect to each other.

Preferably, the bendable part of the floor panel comprises the first recess arranged parallel to the short edge.

Preferably, the recesses have decreasing heights, with the recesses having the smallest height on the side of the male coupling element located at the first long edge of the side surface and the largest height on the side of the female coupling element located at the second long edge of the side surface.

Preferably, the recesses have decreasing widths, with the recesses of the smallest width on the side of the male coupling element located at the first long edge of the side surface and the recesses of the largest width on the side of the female coupling element located at the second long edge of the side surface.

Preferably, the ratio of the largest recess height to the height of the floor panel is within a range from 0.1 to 0.4, and the ratio of the smallest height to the largest recess height is within a range from 0.1 to 0.5.

Preferably, the ratio of the smallest width of the recess to its largest width is within a range from 0.2 to 0.4, and the ratio of the largest height of the recess to its largest width is within a range from 0.8 to 1.2.

Preferably, feet with a width larger than half of the largest width of the recess are formed between the recesses.

Advantageous Effects of Invention

The invention allows the angular deflection of the male joining part to be increased, relative to the horizontal plane, during its interlocking with the female joining part at the short edges. It is also possible to join short edges with a reduced pressing force on the male joining part, wherein the angular arrangement of the recesses facilitates and speeds up the interlocking operation of the short edges, because with this arrangement of the recesses, the increased pressing force on the male joining part is generally only necessary in the first pressing step. With such a solution, there is no need to bend the short side and gradually push in the male joining part located on the short edge of the floor panel.

The invention allows the angular deflection of the male joining part to be increased when it is interlocked with the female joining part at the short edges. It is also possible to join short edges with an essentially decreasing pressing force on the male joining part.

BRIEF DESCRIPTION OF DRAWINGS

The subject of the invention is shown in embodiments in a drawing, in which.

DESCRIPTION OF EMBODIMENTS

Figure 1:
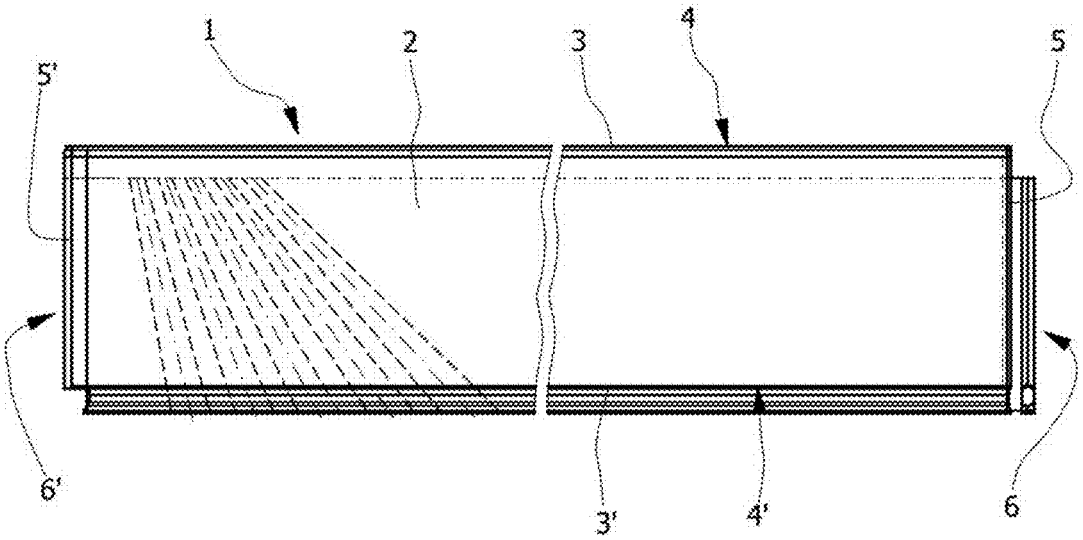
FIG. 1 shows the floor panel in top view.

The floor panel 1 shown in FIG. 1 is in the form of a rectangular plate, with a core made of a conglomerate of polyvinyl chloride and chalk, with its upper surface 2 delimited by two long edges 3, 3' of side surfaces 4, 4' and by two short edges 5, 5' of side surfaces 6, 6'.

Figure 2:
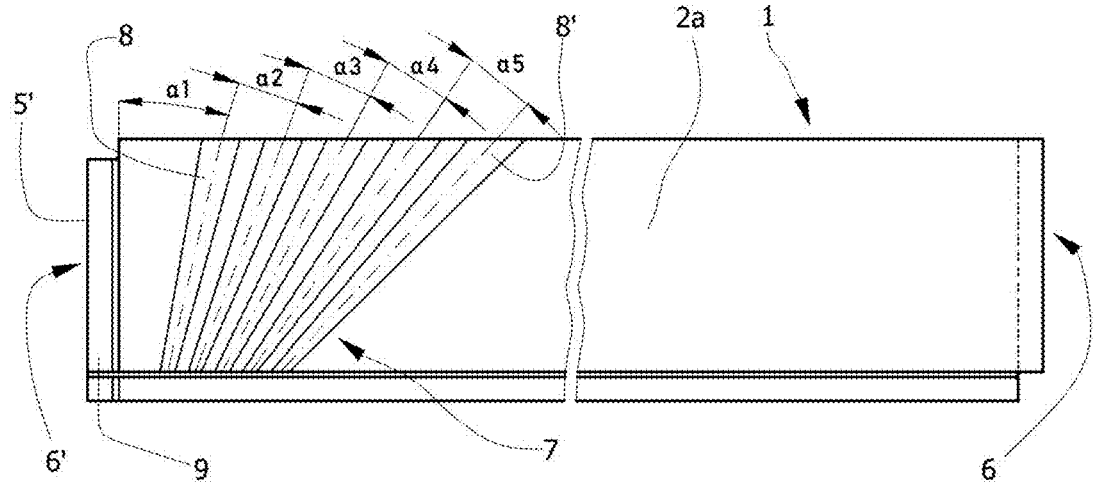
FIG. 2 shows the floor panel in bottom view.

As shown in FIG. 2, in the lower surface 2*a* of the floor panel 1, across its entire width, a bendable part 7 comprising five adjacent recesses 8, 8' in the form of grooves, located next to a male joining part 9, is formed. Therefore, the recesses 8, 8' extend from the side surface 4 to the side surface 4'. The first of these recesses 8 on the side of the short edge 5' is made at an angle $\alpha 1$ with respect to this short edge 5'. The further four recesses 8' are inclined relative to each other at angles $\alpha 2$, $\alpha 3$, $\alpha 4$, $\alpha 5$. In this embodiment, the angle $\alpha 1=15°$, and the angles $\alpha 2=\alpha 3=\alpha 4=\alpha 5=7.5°$, which means that the last recess 8' on the side of the short edge 5' is inclined at an angle of 45° with respect to this short edge 5'. Depending on the bending characteristics required for the bendable part 7 for the proper positioning of the male joining part 9 when joining the floor panels 1, the inclination angle $\alpha 1$ of the first recess 8 and the inclination angles $\alpha 2$, $\alpha 3$, $\alpha 4$ and $\alpha 5$ between adjacent recesses can assume different values. If more than one obliquely arranged recess 8, 8' is used, the inclination angles between adjacent recesses should be reduced accordingly, so that the last recess 8' on the side of the short edge 5' is inclined preferably by the angle not exceeding 45°.

Figure 3:
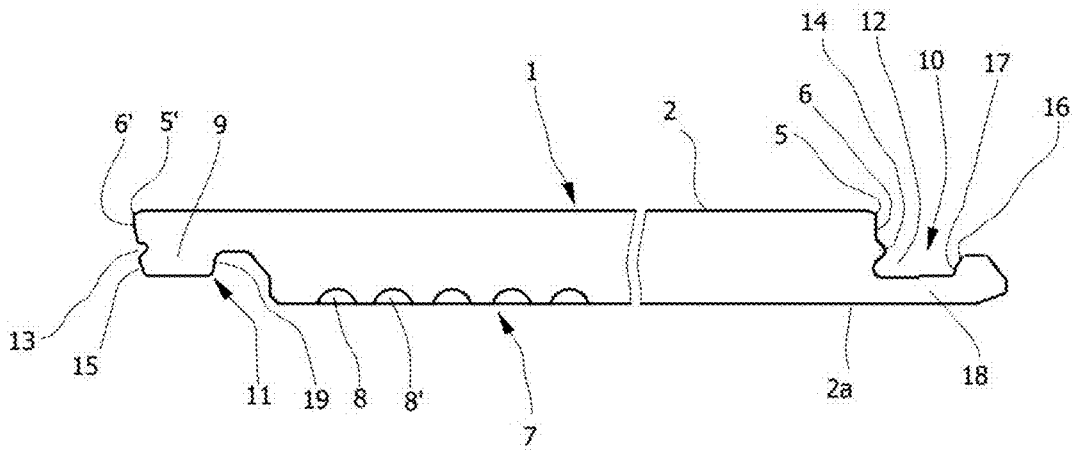
FIG. 3 shows the floor panel in cross-section.

As shown in FIG. 3, complementary interlocking means 10, 11 are formed on the side of the short edges 5, 5' being joined to each other during assembly. These complementary interlocking means 10, 11, after joining the male joining part 9 to the female joining part 12, lock the joined floor panels 1 in a direction perpendicular to the upper surface 2 and in a direction parallel to this upper surface 2 and to the lower surface 2*a*. In order to lock the floor panels 1 in the perpendicular direction, the male joining part 9 has a vertically active concave locking part 13 and the female joining part 12 has a vertically active convex locking part 14. Furthermore, the male joining part 9 has a slanted guiding surface 15 formed below the concave locking part 13, while the female joining part 12 has a slanted guiding surface 16 transitioning into an inner bearing surface 17 formed on a protruding coupling element 18. This slanted guiding surface 16 is intended for sliding interfacing with an inner side surface 19 of the male joining part 9. The bendable part 7 is notched in the lower surface 2*a* of the floor panel 1 on the side of the male joining part 9 and is in the form of recesses 8, 8', wherein both the first recess 8 on the side of the short edge 5' and the further recesses 8' are diagonally arranged with respect to it.

Figure 4:
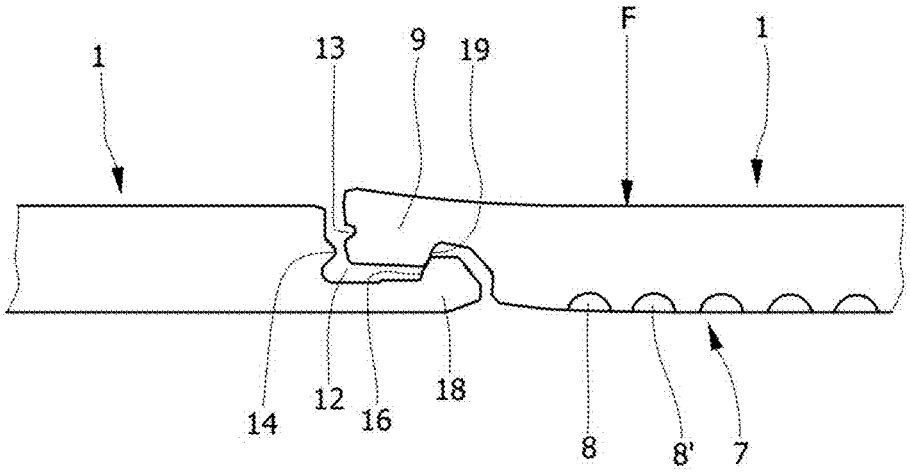
FIG. 4 shows a male part of the floor panel before joining to a female part of the same floor panel.
Figure 5:
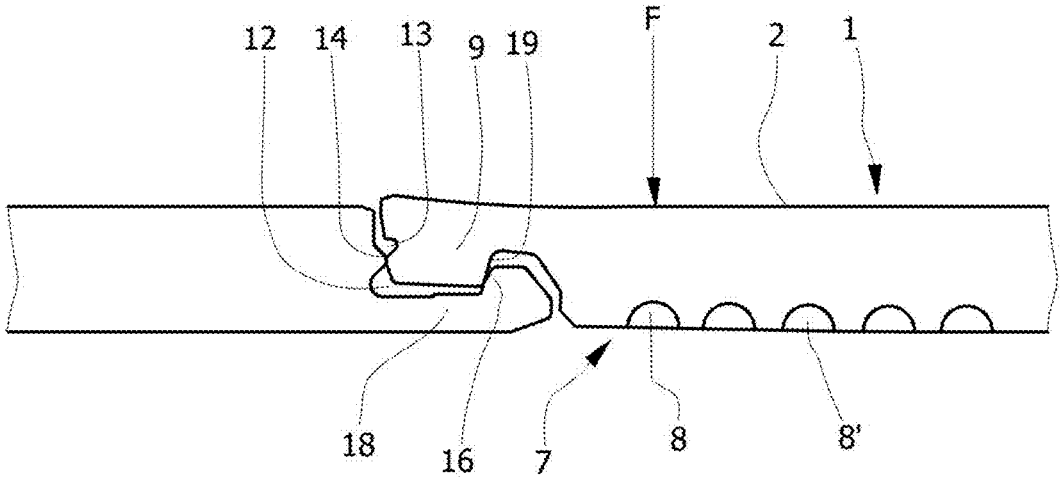
FIG. 5 shows the male part of the floor panel in the process of joining to the female part of the same floor panel.

FIG. 4 and FIG. 5 show the arrangement of the joined elements during the process of interlocking the adjacent floor panels 1. FIG. 4 shows the arrangement of the inner side surface 19 of the male joining part 9 over the slanted guiding surface 16 of the protruding coupling element 18.

As shown in FIG. 5, after exerting a pressing force F on the upper surface 2 of the floor panel 1, the resulting bending moment bends the bendable part 7, thereby deforming the recesses 8, 8' and thus adapting the position of the male joining part 9 to the shape of the female joining part 12, whereby the inner side surface 19 of the male joining part 9 is moved without collision along the slanted guiding surface 16 of the protruding coupling element 18 and the convex locking part 14 is seated in the concave locking part 13.

Figure 6:
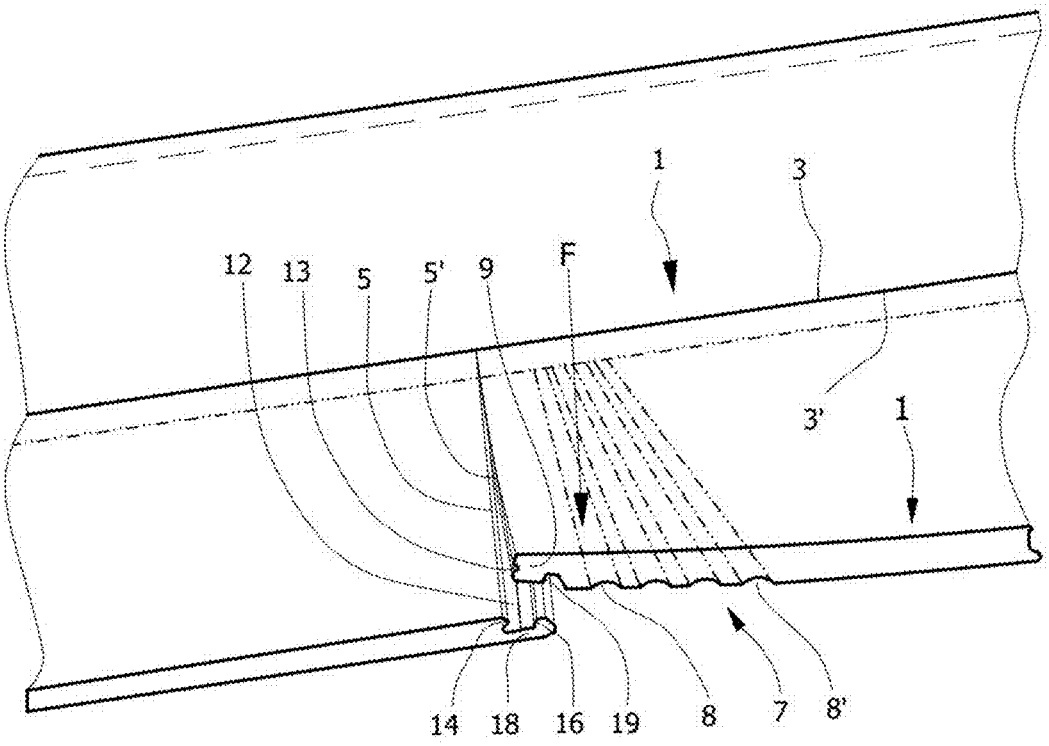
FIG. 6 shows the male part of the floor panel in the process of joining to the female part of the same floor panel in axonometric view.

FIG. 6 shows the step of partial joining of the floor panels also in axonometric view. The floor panels 1 are first joined at their long edges 3, 3'. During the angular inclination of the floor panel 1 being joined, under the pressing force F, the adjacent recesses 8, 8' of the bendable part 7 deform elastically and the male joining part 9 gradually fits into the space of the female joining part 12. In this step, the inner side surface 19 slides over the slanted guiding surface 16 of the protruding coupling element 18. The moment the convex locking part 14 of the female joining part 12 is near the level of the concave locking part 13 of the male joining part 9, the step of engaging the short edges 5, 5' located near the long edges 3, 3' occurs. Through the use of the widening recesses 8, 8', the joining of the floor panels in the region where the recesses 8, 8' have a small dimension is achieved under an increased pressing force F, but in the further area where the recesses 8, 8' are correspondingly larger, the necessary pressing force F decreases significantly.

In the embodiment shown in FIG. 6, the bendable part 7 of the floor panel 1 has the first recess 8 arranged parallel with respect to the short edge 5', and the further recesses 8' are inclined with respect to this short edge 5' and with respect to each other.

Figure 7:
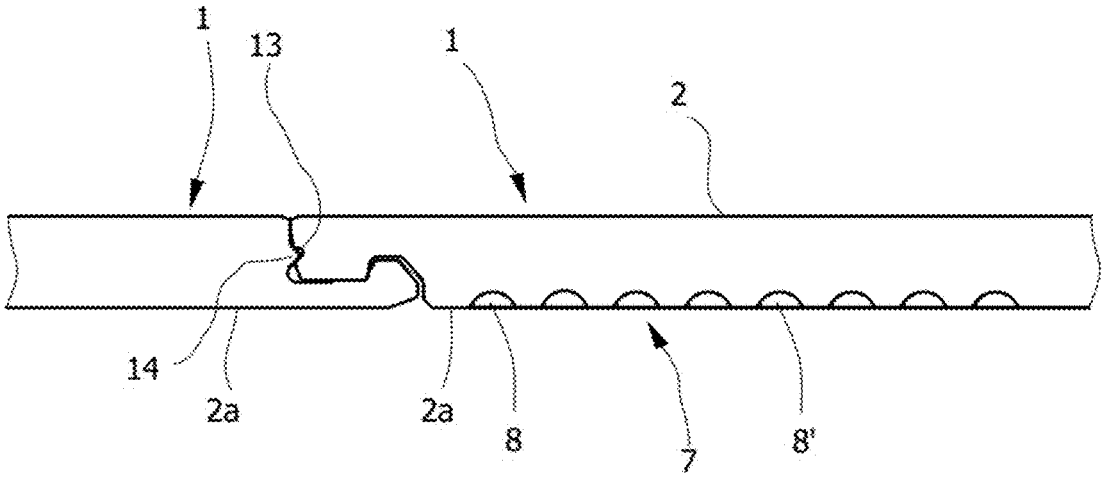
FIG. 7 shows the joined floor panels.

After the floor panels 1 are completely joined together, as shown in FIG. 7, when the convex locking part 14 is inserted into the concave locking part 13, the bendable part 7 of the lower surface 2*a* returns to a flat shape corresponding to the floor plane.

Figure 8:
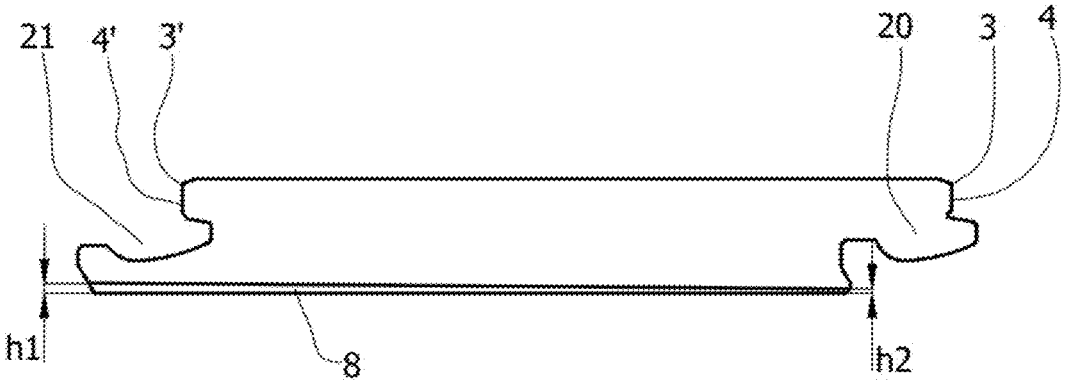
FIG. 8 shows a cross-section of the floor panel along its recess.

FIG. 8 shows the decreasing dimension of the recess 8. In the embodiment shown, this changing dimension also applies to the further recesses 8'. The recesses 8, 8' have a continuously decreasing height h1, h2, with the smallest height h2 of the recess 8, 8' being on the side of the male coupling element 20 located at the first long edge 3 of the side surface 4, as shown in FIG. 7, the largest height h1 of the recess 8 being reached on the side of the female coupling element 21 located at the second long edge 3' of the side surface 4'.

Figure 9:
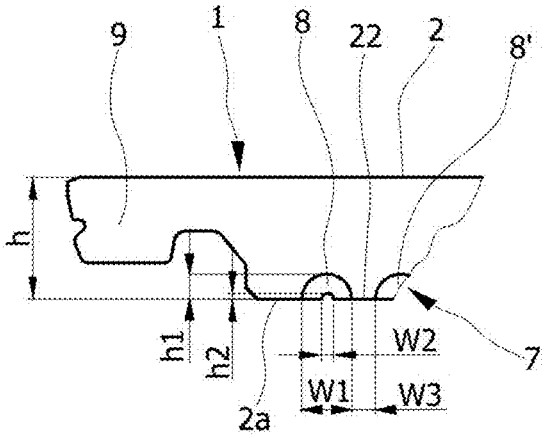
FIG. 9 shows an enlarged view of the section of the floor panel as seen in the direction of the recess axis.

FIG. 9 shows a part of the floor panel 1 with the recesses 8, 8'. The floor panel 1 has the bendable part 7 formed by the recesses 8, 8'. The largest height h1 of the recesses in this embodiment is 0.2 of the height h of the floor panel 1. In the case of using the floor panel 1 made of SPC conglomerate comprising 65% of chalk, with the height h of the floor panel 1 equal to 6 mm, the largest height h1 of the groove is equal to 3 mm, and the smallest height h2 is equal to 0.5 mm. The largest width W1 of the recesses 8, 8' is the same as the largest height h1 and is equal to 3 mm, and the smallest width W2 is equal to 1 mm. In preferred embodiments, the ratio of the smallest height h2 to the largest height h1 may be within the range from 0.1 to 0.5, the ratio of the smallest width W2 to the largest width W1 may be within the range from 0.2 to 0.5, and the ratio of the largest height h1 to the largest width W1 of the recesses 8, 8' may be within the range from 0.8 to 1.2.

The recesses 8, 8' are separated by feet 22 of width W3. With the largest width W1 of 3 mm, the width W3 of the foot 22 is 2 mm.

With most of materials used, the width W3 of the foot 22 being lower than 0.5 mm results in a failure to meet the strength requirements associated with the need to carry the vertical loads arising from the use of the laid floor in the location of the recesses 8, 8'. The parameters of the bendable part 7, such as the number of recesses 8, 8', the inclination angles α1, α2, α3, α4, α5, width W1, width W2, width W3, height h1 and h2 may differ from the given preferred values and should be selected depending on the strength properties of the materials used and on the shape of the male joining part 9 and the female joining part 12, so that the proper shape of the bend of the bendable part 7 can be achieved, allowing the sliding interfacing of the surfaces to be joined and the assumed dosage of the pressure force F required for joining the floor panels 1.

REFERENCE SIGNS LIST

1 Floor panel;
2 Upper surface;
2*a* Lower surface;
3, 3' Long edges;
4, 4' Side surfaces;
5, 5' Short edges;
6, 6' Side surfaces;
7 Bendable part;
8, 8' Recesses;
9 Male joining part;
10 Interlocking means;
11 Interlocking means;
12 Female joining part;
13 Concave locking part;
14 Convex locking part;
15 Slanted guiding surface of the male joining part 9;
16 Slanted guiding surface of the female joining part 12;
17 Inner bearing surface;
18 Protruding coupling element;
19 Inner side surface;
20 Male coupling element at the long edge;
21 Female coupling element at the long edge;
22 Foot;
α1, α2, α3, α4, α5 inclination angles;
h Height of the floor panel;
h1 Largest height of the recess;
h2 Smallest height of the recess;
W1 Largest width of the recess;
W2 Smallest width of the recess;
W3 Width of the foot.

The invention claimed is:

1. A joint of floor panels, wherein the joined floor panels (1) are in the form of rectangular plates comprising:

an upper surface (2) and a lower surface (2*a*) parallel to it, designed to be laid on the subfloor, two long edges (3, 3') of side surfaces (4, 4'), two short edges (5, 5') of side surfaces (6, 6'), complementary interlocking means (10, 11) formed on the side of the edges (5, 5') joined to each other, wherein the complementary interlocking means (10, 11) formed on the side of the short edges (5, 5') joining each other comprise joining parts made as a male joining part (9) and a female joining part (12) and have a vertically active concave locking part (13) and a convex locking part (14), as well as slanted guiding surfaces (15, 16), and wherein a bendable part (7) is formed in the lower surface (2*a*) of the floor panel (1) across its entire width, wherein the bendable part (7) of the floor panel (1) comprises a plurality of adjacent recesses (8, 8') formed in the lower surface (2*a*), next to the male joining part (9), which are inclined relative to the short edge (5') of the side surface (6'), allowing the angular deflection of the male joining part (9) to be increased, relative to the horizontal plane, during its interlocking with the female joining part (12) at the short edges (5, 5'), characterized in that the recesses (8, 8') have decreasing heights, with the recesses (8, 8') having the smallest height (h2) on the side of a male coupling element (20) located at the first long edge (3) of the side surface (4) and the largest height (h1) on the side of a female coupling element (21) located at the second long edge (3') of the side surface (4').

2. The joint according to claim 1, characterised in that the bendable part (7) of the floor panel (1) comprises 3 to 20 adjacent recesses (8, 8').

3. The joint according to claim 1, characterised in that the bendable part (7) of the floor panel (1) comprises 4 to 10 adjacent recesses (8, 8').

4. The joint according to claim 1, characterised in that the first recess (8) on the side of the short edge (5') is inclined by an angle (α1) greater than the inclination angle (α2, α3, α4, α5) of the further recesses (8') with respect to each other.

5. The joint according to claim 1, characterised in that the bendable part (7) of the floor panel (1) comprises the first recess (8) arranged parallel to the short edge (5').

6. The joint according to claim 1, characterised in that the recesses (8, 8') have decreasing widths, with the recesses (8, 8') having the smallest width (W2) on the side of the male coupling element (20) located at the first long edge (3) of the side surface (4) and the largest width (W1) on the side of the female coupling element (21) located at the second long edge (3') of the side surface (4').

7. The joint according to claim 1, characterised in that the ratio of the largest height (h1) of the recess (8, 8') to the height (h) of the floor panel (1) is within a range from 0.1 to 0.5, and the ratio of the smallest height (h2) to the largest height (h1) of the recess (8, 8') is within a range from 0.1 to 0.5.

8. The joint according to claim 6, characterised in that the ratio of the smallest width (W2) of the recess (8, 8') to its largest width (W1) is within a range from 0.2 to 0.5, and the ratio of the largest height (h1) of the recess (8, 8') to its largest width (W1) is within a range from 0.8 to 1.2.

9. The joint according to claim 8, characterised in that feet (22) with a width (W3) larger than half of the largest width (W1) of the recess (8, 8') are formed between the recesses (8, 8').

10. The joint according to claim 7, characterised in that the ratio of the smallest width (W2) of the recess (8, 8') to its largest width (W1) is within a range from 0.2 to 0.5, and the ratio of the largest height (h1) of the recess (8, 8') to its largest width (W1) is within a range from 0.8 to 1.2.

* * * * *